US007568924B2

(12) United States Patent
Kinsey, Jr.

(10) Patent No.: US 7,568,924 B2
(45) Date of Patent: Aug. 4, 2009

(54) ELECTRICAL CONNECTOR WIRE GUIDE WITH HINGED CAM LOCK

(75) Inventor: Forrest Irving Kinsey, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/810,308

(22) Filed: Jun. 5, 2007

(65) Prior Publication Data

US 2008/0305673 A1 Dec. 11, 2008

(51) Int. Cl.
*H01R 13/62* (2006.01)

(52) U.S. Cl. ..... 439/157

(58) Field of Classification Search ..... 439/157, 439/152, 369, 352, 347, 372; 248/68.1; 174/100
See application file for complete search history.

(56) References Cited

U.S. PATENT DOCUMENTS 5,902,961 A * 5/1999 Viklund et al. ..... 174/100
5,938,458 A * 8/1999 Krehbiel et al. ..... 439/157
6,213,795 B1 * 4/2001 Drescher et al. ..... 439/157

* cited by examiner

*Primary Examiner*—Alexander Gilman

(57) ABSTRACT

A wire guide (10) is disclosed that is removably attachable to an electrical connector (11) for guiding wires terminated thereto. Guide arms (24, 26, 28, 30) extend from a body 20 and include alignment members (122, 124) for engaging alignment features (126, 128) on the connector during assembly. The guide arms include catch fingers (56, 58, 68, 70) that engage catch features (34, 36, 40, 42) on the connector. Two hinged cam locks (90, 110), each being arranged between respective pairs of guide arms, are manually manipulated to cause the catch fingers to engage their respective catch features thereby positively securing the wire guide to the connector.

20 Claims, 4 Drawing Sheets

ELECTRICAL CONNECTOR WIRE GUIDE WITH HINGED CAM LOCK

The present invention relates to wire guides removably attachable to an electrical connector for guiding the wires connected thereto into a neat bundle and more particularly to wire guides having an improved alignment and locking mechanism for securing the wire guide to the connector.

BACKGROUND OF THE INVENTION

Wire guides for electrical connectors are often made of a plastic insulating material and are arranged to attach to a connector housing so that the wires terminated in the housing are guided away from their termination points and into a neat bundle. In many cases the wire guide also serves as a strain relief for the wires. Prior art wire guides are typically attach to their respective connector housings by detents, flexible plastic parts that engage features on the housing, or other mechanisms that easily snap into place. Such wire guides, while easy to install, are prone to accidental disengagement from the connector during the original installation of the connector or during maintenance. Additionally, the flexible plastic parts are necessarily thin and lack sufficient support for securely attaching the wire guide to the connector housing resulting in a loose and tenuous mechanical connection. Such wire guides are susceptible to damage when their removal is attempted for maintenance of the connector.

What is needed is a wire guide of robust design that is easily attached to its connector housing and can then be securely locked in place, yet easily removed for maintenance.

SUMMARY OF THE INVENTION

A wire guide is provided that is removably attachable to an electrical connector for guiding one or more wires extending from the connector. The wire guide includes a body having a wire exit end and a plurality of alignment members extending from the body. The alignment members are arranged to engage alignment features on the connector for aligning the wire guide with the connector. A plurality of catch fingers are coupled to the body for locking engagement with corresponding catch features on the connector. A cam lock is coupled to the body and arranged to effect locking engagement by urging the wire guide and the connector to move in substantially opposite directions so that the catch fingers engage their respective catch features on the connector.

An embodiment of the invention will now be described by way of example with reference to the following drawings.

DESCRIPTION OF AN EMBODIMENT OF THE INVENTION

Figure 1:
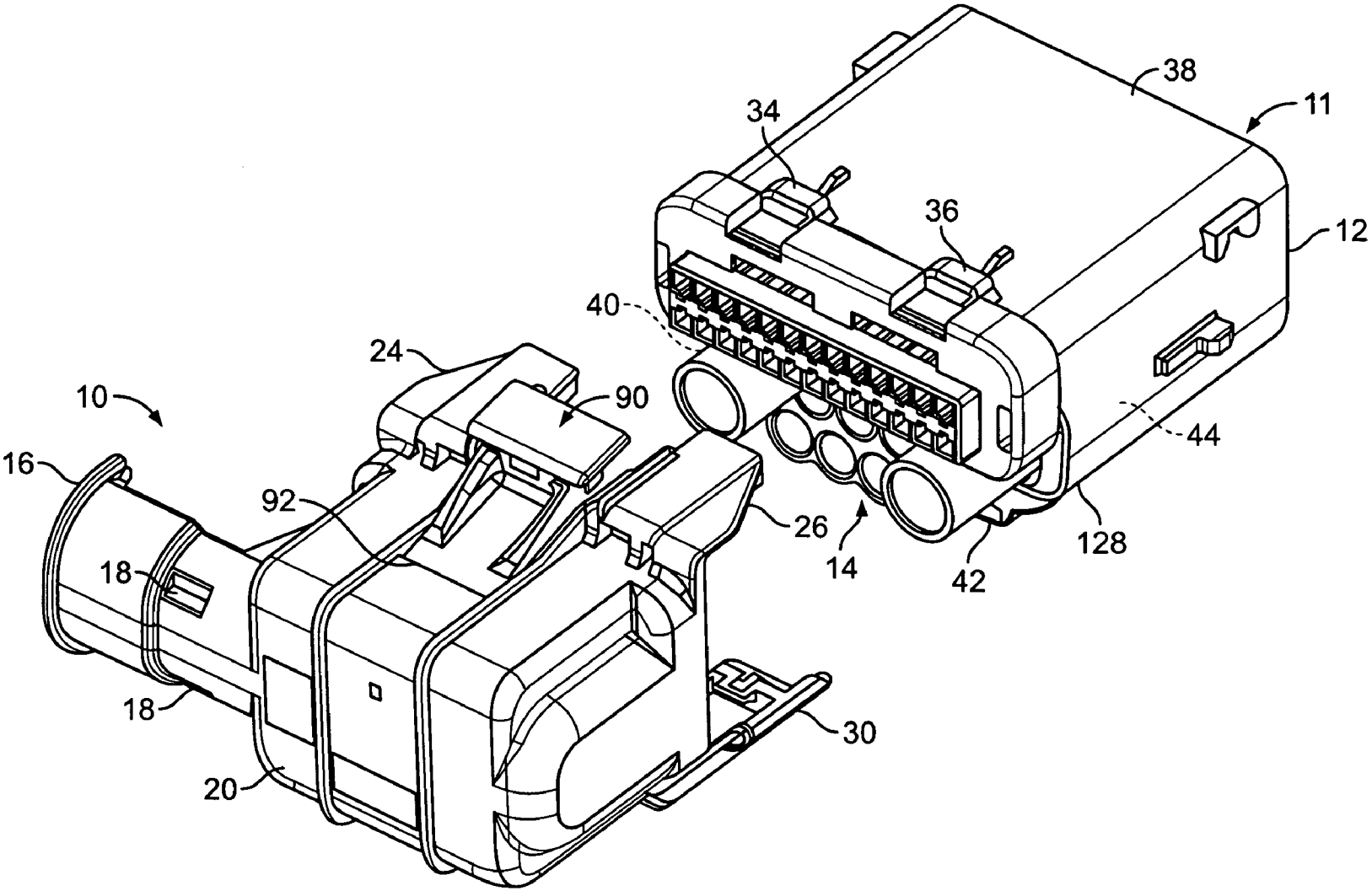
FIG. 1 is an isometric view of a wire guide incorporating the teachings of the present invention, including a mating electrical connector housing.

There is shown in FIG. 1 a wire guide 10 and a mating electrical connector 11 having a housing 12. The connector housing includes a wire terminating end 14 to which a quantity of wires (not shown) may be terminated. The terminated wires are normally grouped into a bundle and directed off to one side. The wire guide 10 includes a wire exit end 16 extending from and integrally molded to a body 20. The wire guide 10 is arranged to mate with the connector housing so that the wire bundle is directed through and partially surrounded by the wire exit end 16. Two tie slots 18 are arranged in the wire exit end permitting bundle ties to be inserted therethrough and wrapped around both the wire bundle and the wire exit end 16 thereby tightly securing the wire bundle to the wire guide 10.

Figure 2:
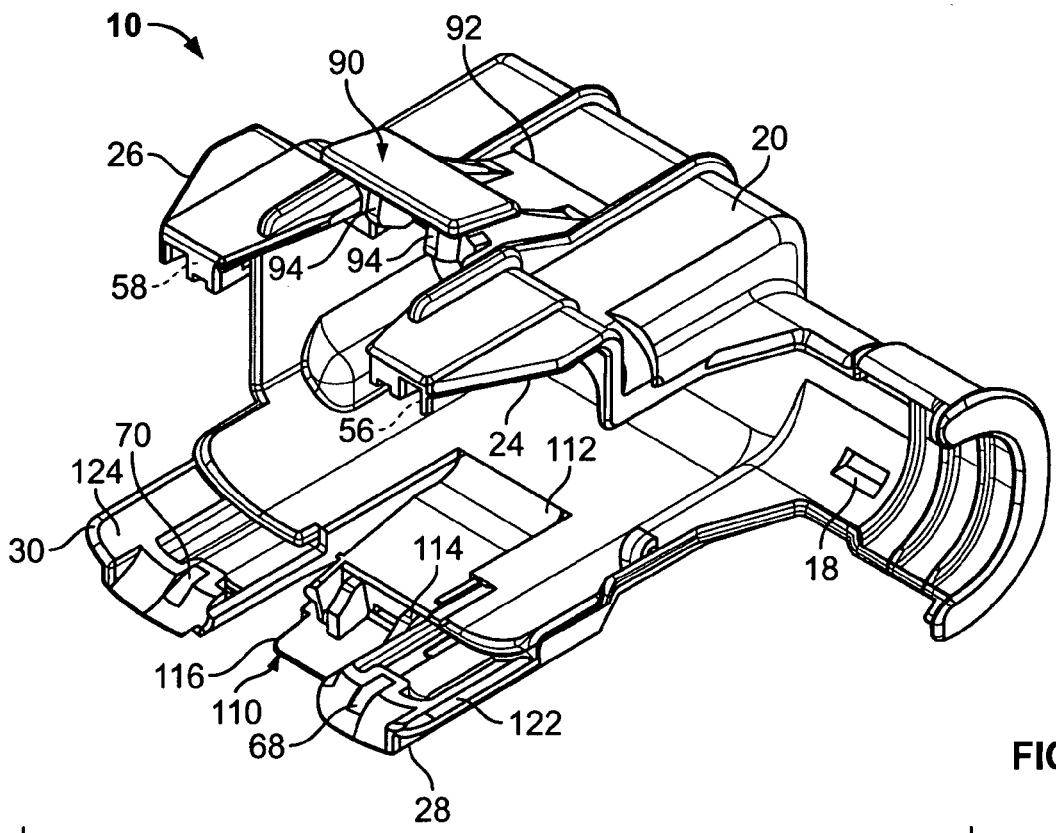
FIG. 2 is an isometric view of the wire guide of FIG. 1 shown at a different angle.
Figure 5:
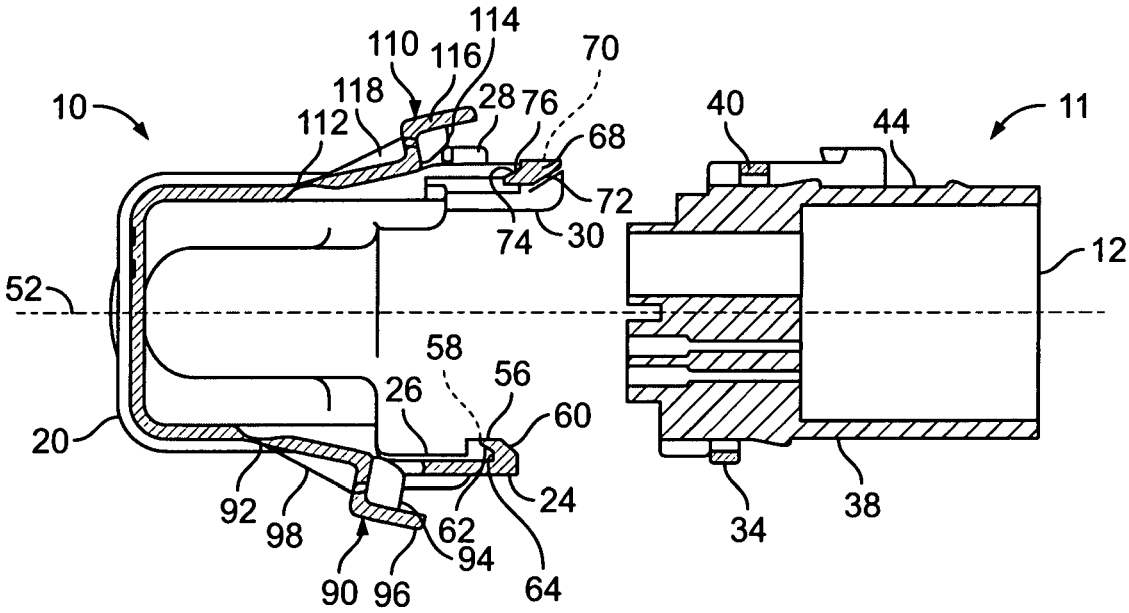
FIG. 5 is a cross-sectional view of the wire guide and housing taken along the lines 5-5 in FIG. 4.
Figure 6:
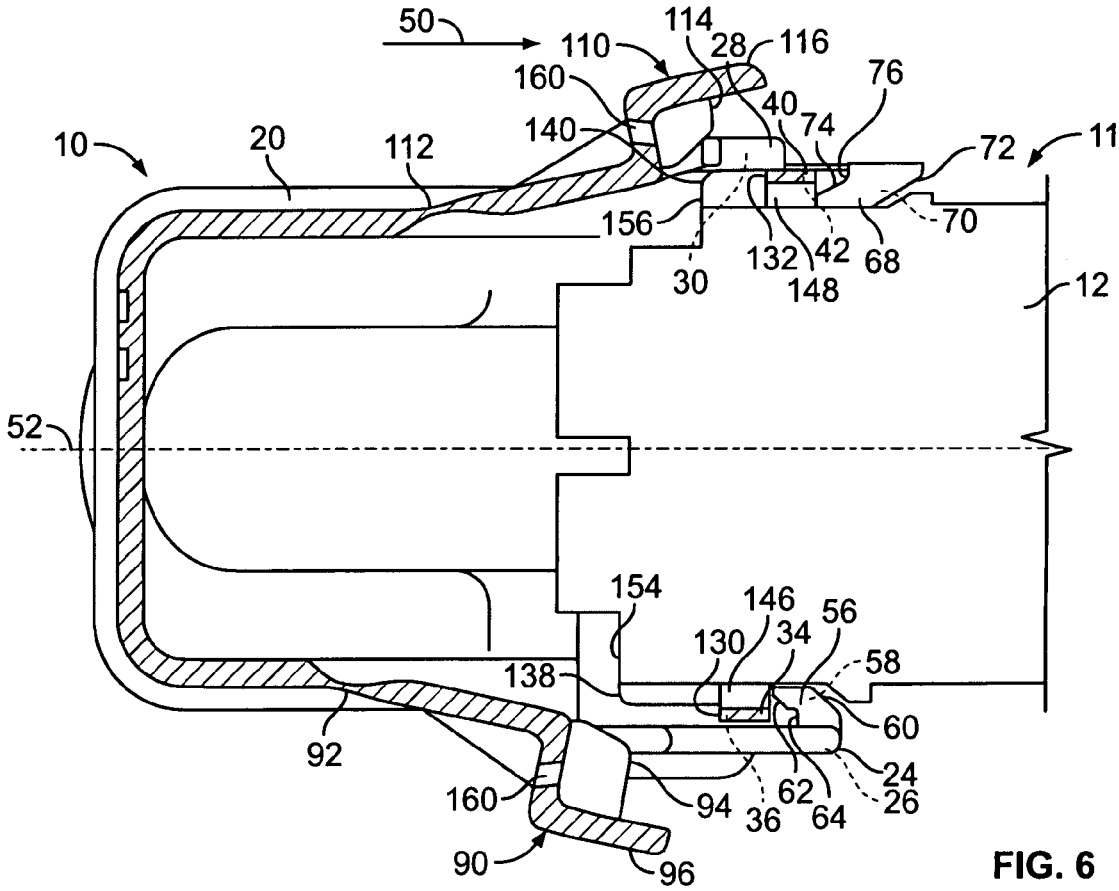
FIG. 6 is a partial cross-sectional view similar to that of FIG. 5.

The wire guide 10 includes a first pair of guide arms 24 and 26 extending from one side thereof and a second pair of guide arms 28 and 30 extending from an opposite side thereof, as best seen in FIGS. 1 and 2. The first and second pairs of guide arms are spaced so that they serve as alignment members and closely embrace the connector housing when fully mated, as will be described in detail below. Such mating will be effected by moving the wire guide 10 along a common axis into mating engagement with the connector housing 12. The connector housing 12 has a first pair of catch features in the form of U-shaped cleats 34 and 36 extending outwardly from one side 38, as shown in FIG. 1, and spaced to conform to the spacing of the first pair of guide arms 24 and 26. A second pair of catch features in the form of U-shaped cleats 40 and 42 extend outwardly from a side 44 opposite the side 38 of the connector housing, as shown in FIG. 1, and are spaced to conform to the spacing of the second pair of guide arms 28 and 30. As shown in FIGS. 2 and 5, the two guide arms 24 and 26 include two catch fingers 56 and 58, respectively. Each catch finger 56 and 58 includes a lead in surface 60, an angled catch surface 62, and adjacent abutting surface 64, as best seen in FIGS. 5 and 6. Similarly, the two guide arms 28 and 30 include two catch fingers 68 and 70, respectively. Each catch finger 68 and 70 includes a lead in surface 72, an angled catch surface 74, and an adjacent abutting surface 76.

Figure 3:
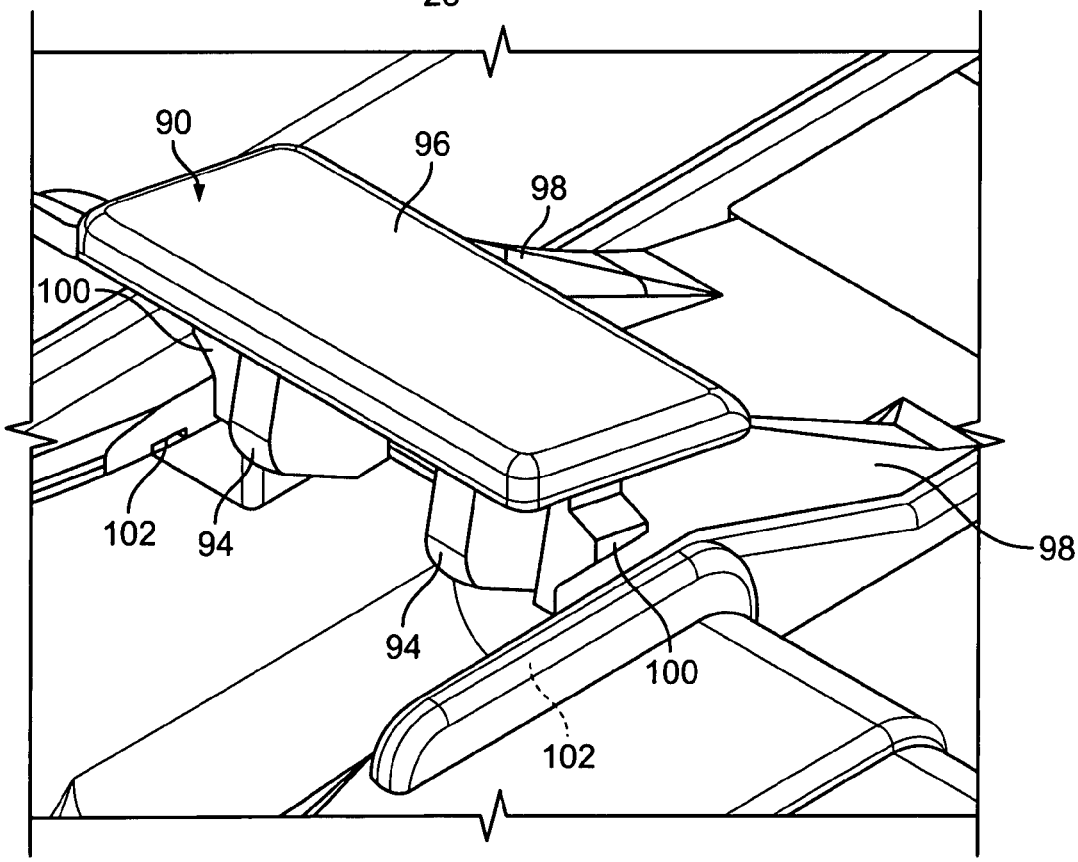
FIG. 3 is an enlarged isometric view of a portion of a cam lock shown in FIG. 2.

A hinged cam lock 90 is arranged between the first pair of guide arms 24 and 26, as best seen in FIGS. 1 and 2. The cam lock 90 is hingedly attached to the wire guide 10 by means of a reduced thickness area 92 in the wall of the wire guide which forms a hinge or pivotal point for the cam lock, as shown in FIGS. 1, 2, and 5. The cam lock 90 includes a pair of spaced cam surfaces 94 extending inwardly generally toward an axis 52 as viewed in FIG. 5. The axis 52 is a common axis extending substantially through the center of both the wire guide 10 and the connector housing 12. The cam lock 90 includes a push tab 96 for manually moving the cam lock toward and away from the axis 52 when assembling the wire guide 10 to the connector housing 12 or when disassembling the parts. Two gussets 98 are integrally molded into the cam lock 90, as best seen in FIGS. 3 and 5, to provide rigidity to the cam lock. A small projection 100 extends from each side of the cam lock 90, as best seen in FIG. 3, and is arranged to interferingly engage corresponding depressions 102 in the adjacent side walls of the wire guide 10 when the cam lock 90 is placed into its closed and locked position. The projections 100, when engaged in their respective depressions, serve as a detent to hold the cam lock 90 in its closed and locked position as will be explained below. Similarly, a second hinged cam lock 110 is arranged between the second pair of guide arms 28 and 30, as best seen in FIGS. 2 and 5. The cam lock 110 is hingedly attached to the wire guide 10 by means of a reduced thickness area 112 in the wall of the wire guide which forms a hinge or pivotal point for the cam lock, as shown in FIGS. 2 and 5. The cam lock 110 includes a pair of spaced cam surfaces 114 extending inwardly generally toward the axis 52 as viewed in FIG. 5. The cam lock includes a push tab 116 for manually moving the cam lock toward and away from the axis 52. Two gussets 118 are integrally molded into the cam lock 110, as best seen in FIG. 5, to provide rigidity to the cam lock. A small projection 100 (not shown) extends from each side of the cam lock 110 in a manner identical to that of the cam lock 90 and is arranged to interferingly engage corresponding depressions 102 (not shown) in the adjacent side walls of the wire guide 10 when the cam lock 110 is placed into its closed and locked position. The projections 100, when engaged in their respective depressions, serve as a detent to hold the cam lock 110 in its closed and locked position.

Figure 4:
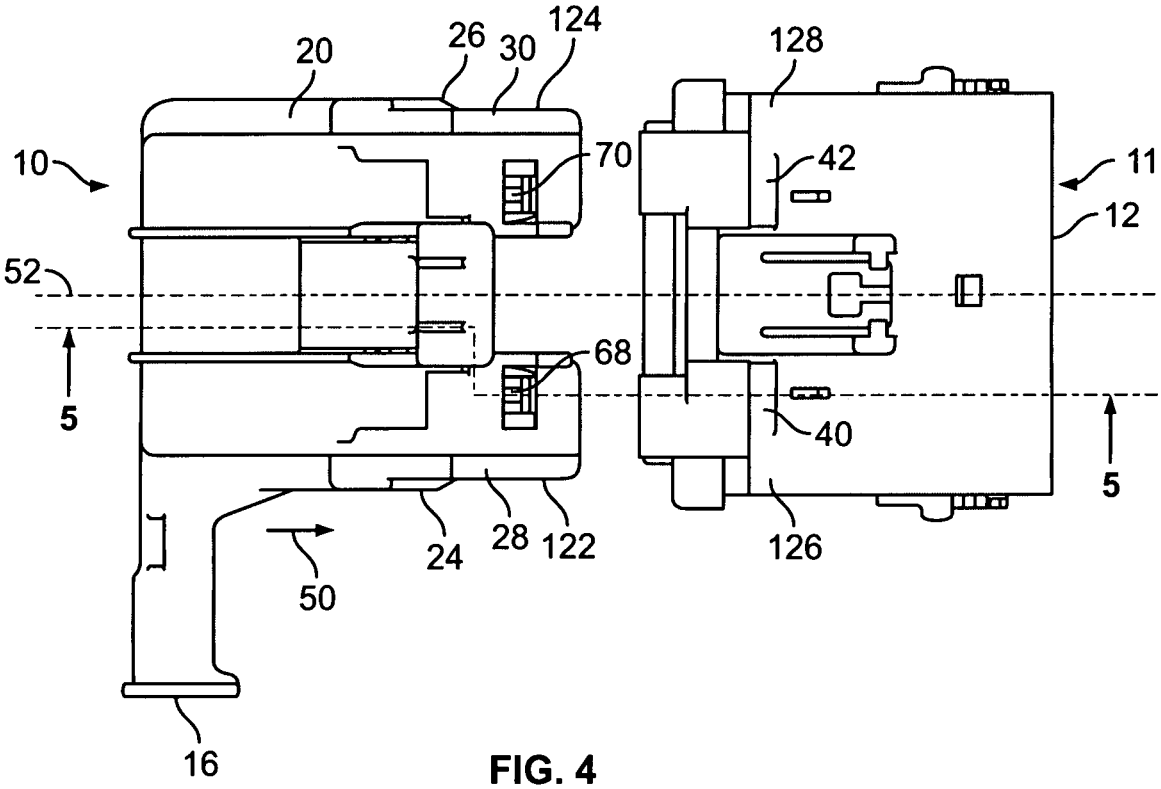
FIG. 4 is a plan view of the wire guide and electrical connector housing shown in FIG. 1.
Figure 7:
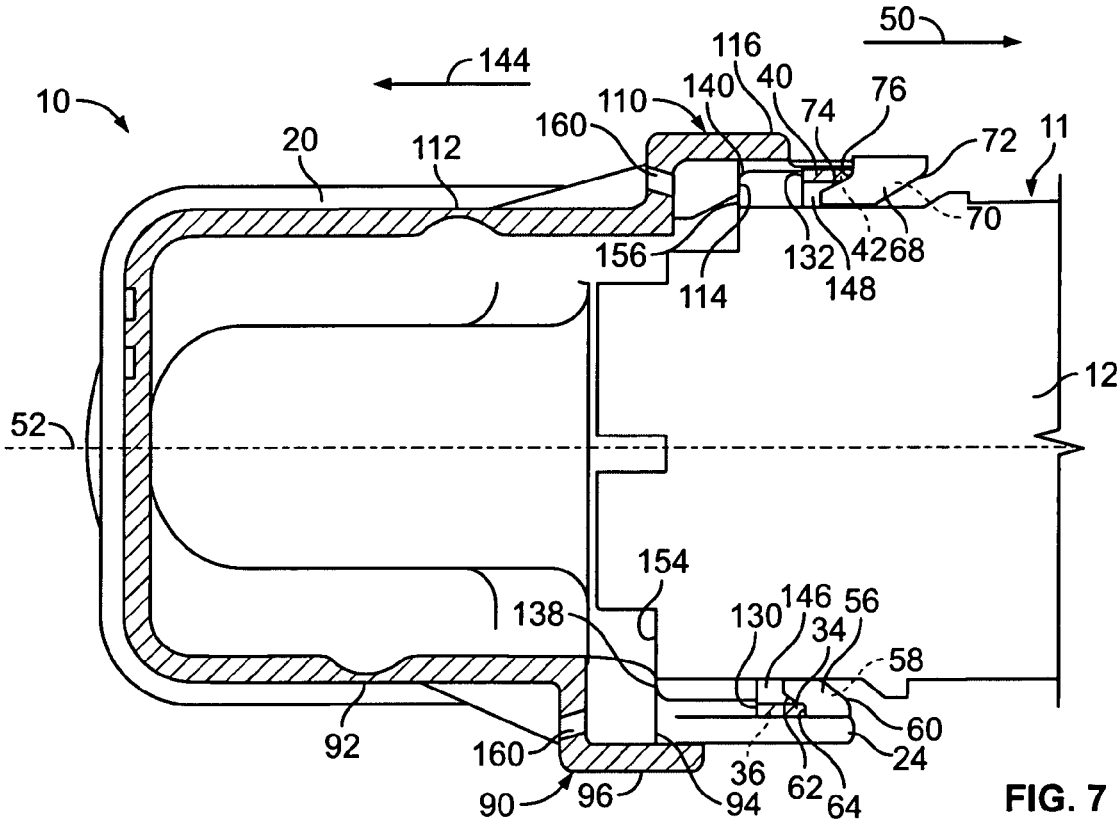
FIG. 7 is a partial cross-sectional view similar to that of FIG. 5 showing the wire guide in its closed and locked position.

When the wire guide 10 is mated to the connector housing 12 it is moved in the direction of the arrow 50, shown in FIGS. 4 and 6, toward the connector housing and along the axis 52. Additional alignment members in the form of a side skirt 122 formed on the guide arm 28 and a corresponding side skirt 124 formed on the guide arm 30, as best seen in FIGS. 2 and 4, are brought into alignment with alignment features 126 and 128 on the connector housing. The alignment features 126 and 128 are radiused portions of the housing adjacent the U-shaped cleats 40 and 42 respectively. With reference to FIG. 6, as the wire guide 10 continues to move in the direction of the arrow 50 the lead in surfaces 60 of the two catch fingers 56 and 58 each engages a front surface 130 of the first pair of U-shaped cleats 34 and 36 causing the first pair of guide arms 24 and 26 to resiliently flex outwardly allowing the catch fingers 56 and 58 to ride over the cleats 34 and 36 and drop down into latching position as shown in FIG. 6. Concurrently the lead in surfaces 72 of the two catch fingers 68 and 70 engage front surfaces 132 of the second pair of U-shaped cleats 40 and 42 causing the second pair of guide arms 28 and 30 to resiliently flex outwardly allowing the catch fingers 68 and 70 to ride over the cleats 40 and 42 and drop down into latching position as shown in FIG. 6. To complete the mating process the two push tabs 96 and 116 are simultaneously urged inwardly toward the axis 52. This will cause the two cam surfaces 94 to engage a radiused receiving surface 138 on the connector housing and the two cam surfaces 114 to engage a radiused receiving surface 140 on the opposite side of the connector housing. As the two push tabs 96 and 116 are further moved inwardly the cam surfaces interact with the receiving surfaces thereby urging the wire guide 10 to move in a direction indicated by the arrow 144 and the connector housing 12 to move in the opposite direction indicated by the arrow 50 in FIG. 7. As this occurs the two catch fingers 56 and 58 enter into openings 146 formed by the U-shaped cleats 34 and 36 and the two catch fingers 68 and 70 enter into openings 148 formed by the U-shaped cleats 40 and 42. As the two push tabs 96 and 116 are moved inwardly, in a direction substantially normal to the axis 52, to their respective limits the two cam surfaces 94 engage an abutting surface 154 on the housing 12 and the two cam surfaces 114 engage an abutting surface 156 on the opposite side of the housing 12 as best seen in FIG. 7. At this point the projections 100 on each side of the two push tabs interferingly engage their respective depressions 102 thereby securing the hinged cam locks 90 and 110 in their closed and locked positions, thereby securing the wire guide 10 to the connector 11. Should the connector require maintenance, there is a slot 160 formed in each of the cam locks 90 and 110, as best seen in FIGS. 6 and 7, for receiving the blade of a flat tool, such as a screwdriver, to pry the cam lock open. This will allow the removal of the wire guide 10 from the connector 11. Note that the side skirts 122 and 124 on the guide arms 28 and 30, respectively, substantially strengthen the guide arms thereby contributing to the overall robustness of the wire guide 10.

It will be understood that the detailed physical features of the wire guide 10, as set forth above, are by way of example only and that reasonable variations thereof may be made by the skilled art worker without departing from the spirit and scope of the teachings of the present invention. The receiving surfaces 138 and 140 may be sharp corners, radii, chamfers, or any other suitable shape; the catch features may take forms other than the U-shaped cleats set forth in the above description; and the two cam surfaces of each cam lock may be only a single surface or multiple surfaces. These are only three examples of many such variations that will be apparent to those skilled in the art.

An important advantage of the present invention is the positive securing of the wire guide to the connector so that accidental separation is minimized. Another advantage is the ease with which the wire guide is secured to the connector by means of the two cam locks. Additionally, the wire guide is substantially more robust than prior art wire guides thereby eliminating or reducing inadvertent damage when handling during initial assembly to the connector or during maintenance. Further, the wire guide of the present invention is a single molded part that is easily manufactured.

The invention claimed is:

1. A wire guide, removably attachable to an electrical connector along an attachment axis for guiding one or more wires extending from said connector, said wire guide comprising:

(a) a body having a wire exit end;

(b) a plurality of alignment members extending from said body and arranged to engage alignment features on said connector for aligning said wire guide with said connector;

(c) a plurality of catch fingers coupled to said body for locking engagement with corresponding catch features on said connector; and (d) a cam lock coupled to said body and arranged to effect said locking engagement by urging said wire guide and said connector to move in substantially opposite directions along the attachment axis.

2. The wire guide according to claim 1 wherein said urging said wire guide and said connector to move in substantially opposite directions includes moving along an axis common to both said wire guide and said connector.

3. The wire guide according to claim 2 wherein said cam lock is hingedly coupled to said body and arranged to move toward said axis in a direction substantially normal thereto when effecting said locking engagement.

4. The wire guide according to claim 3 wherein said plurality of alignment members include two alignment members having said cam lock positioned therebetween.

5. The wire guide according to claim 4 wherein each catch finger of said plurality of catch fingers is attached to a respective one of said plurality of alignment members, each said alignment member being resiliently movable with respect to said body.

6. The wire guide according to claim 5 wherein each catch finger of said plurality of catch fingers includes an angled catch surface and an adjacent abutting surface which are arranged to lockingly engage an opening adjacent said catch features on said connector when effecting said locking engagement.

7. The wire guide according to claim 1 wherein said cam lock includes a cam surface for engaging a receiving surface on said connector, said cam lock being hingedly coupled to said body and arranged to move so that said cam surface engages said receiving surface thereby effecting said urging of said wire guide and said connector to move in substantially opposite directions.

8. The wire guide according to claim 7 wherein said wire guide includes two cam locks on opposite sides of said wire guide.

9. The wire guide according to claim 8 wherein each said cam lock includes a detent for holding said cam surface in said engagement with said receiving surface.

10. The wire guide according to claim 9 wherein each catch finger of said plurality of catch fingers includes an angled catch surface and adjacent abutting surface which are arranged to lockingly engage an opening adjacent a said catch feature on said connector when effecting said locking engagement.

11. A wire guide, removably attachable to an electrical connector for guiding one or more wires extending from said connector, and comprising a locking mechanism for attaching the wire guide and electrical connector, the locking mechanism comprising an engagement member, said wire guide movable along an axis in a first direction with respect to, and into alignment with, said electrical connector and then upon actuation of said locking mechanism, said engagement member engages the electrical connector and moves the wire guide, along said axis in a second opposite direction into captive attachment therewith.

12. The wire guide according to claim 11 wherein said engagement member includes a cam surface for engaging a receiving surface on said electrical connector, said cam surface arranged to engage said receiving surface thereby urging said wire guide in said second direction with respect to said electrical connector, said cam surface positioned so that it blocks subsequent movement in said first direction.

13. The wire guide according to claim 12 wherein said cam surface is associated with a detent for holding said cam surface in said position blocking subsequent movement in said first direction.

14. An electrical connector assembly, comprising a housing and a wire guide, one of the housing or wire guide including latch members and the other of said housing and wire guide including catches for receiving the latch members, and a force member, wherein the wire guide is receivable on said housing in a first attachment direction, and said force member when actuated, urges said housing and wire guide in a second direction, opposite to said first attachment direction, moving said latches into a locked condition into said catches.

15. The assembly of claim 14, wherein the force member is integral with said wire guide.

16. The assembly of claim 15, wherein the force member is in the form of a cam lock member, movable in a direction generally transverse to said first direction.

17. The assembly of claim 16, wherein the cam lock member is hinged to said wire guide.

18. The assembly of claim 14, further comprising alignment members to align the wire guide to the housing.

19. An electrical connector assembly, comprising a housing and a wire guide, one of the housing or wire guide including latch members and the other of said housing and wire guide including catches for receiving the latch members, and a force member integral with said wire guide and in the form of a cam lock member, wherein the wire guide is receivable on said housing in a first direction, and said force member when actuated is movable in a direction generally transverse to said first direction, and urges said housing and wire guide in a second direction, opposite to said first direction, moving said latches into a locked condition into said catches.

20. The assembly of claim 16, wherein the cam lock member is hinged to said wire guide.

* * * * *